US005501381A

United States Patent [19]

Rogers et al.

[11] Patent Number: 5,501,381

[45] Date of Patent: Mar. 26, 1996

[54] HANDGUN HOLSTER

[75] Inventors: William H. Rogers; Norman E. Clifton, Jr., both of Jacksonville, Fla.

[73] Assignee: Safariland Ltd., Inc., Ontario, Calif.

[21] Appl. No.: 176,766

[22] Filed: Jan. 5, 1994

[51] Int. Cl.[6] ..... F41C 33/00

[52] U.S. Cl. ..... 224/243; 224/196; 224/238; 224/911

[58] Field of Search ..... 224/192, 193, 224/196–198, 224–226, 236, 238, 242–244, 253, 911, 912

[56] References Cited

U.S. PATENT DOCUMENTS

| | | | |
|---|---|---|---|
| Re. 30,139 | 11/1979 | Jones | 224/243 |
| 1,148,935 | 8/1915 | Snavely | 224/243 |
| 3,011,687 | 12/1961 | Boyt | 224/243 |
| 4,270,680 | 6/1981 | Bianchi | 224/193 |
| 4,325,505 | 4/1982 | Hillman | 224/238 |
| 4,591,081 | 5/1986 | Bianchi et al. | 224/192 |
| 4,886,197 | 12/1989 | Bowles et al. | 224/243 |
| 4,925,075 | 5/1990 | Rogers | 224/244 |
| 5,018,653 | 5/1991 | Shoemaker | 224/198 |
| 5,127,566 | 7/1992 | Beletsky | 224/243 |
| 5,284,281 | 2/1994 | Nichols | 224/244 |
| 5,303,860 | 4/1994 | Serafini, Jr. | 224/238 |

FOREIGN PATENT DOCUMENTS

| | | | |
|---|---|---|---|
| 0695930 | 9/1940 | Germany | 224/911 |

*Primary Examiner*—J. Casimer Jacyna
*Attorney, Agent, or Firm*—Arthur G. Yeager

[57] ABSTRACT

A handgun holster having a pivotable semirigid safety strap which prevents withdrawal of the handgun until the strap is selectively released by a force on the strap from a detent by hand manipulation of the user in drawing the handgun after the strap has been pivoted away from the handgun.

21 Claims, 3 Drawing Sheets

HANDGUN HOLSTER

BACKGROUND OF THE INVENTION

This invention relates to a handgun holster with a pivotable semirigid strap to prevent withdrawal of the handgun from the holster until the strap is released from a detent locking device and pivoted forward to release the handgun for withdrawal.

Law enforcement officers, and particularly competitive shooters who have a need to carry a handgun normally do so in a holster, and it is important that the handgun be secure in the holster against falling out when the wearer is running or otherwise involved in activity, and against the possibility of withdrawal by someone other than the wearer. Various arrangements have been used to prevent inadvertent withdrawals from the holster, such as, cover flaps, restraining straps, spring mechanisms, custom molding of the holster to fit each gun, and the like. Typical of such holsters are those shown in Bianchi U.S. Pat. No. 4,101,060; Rogers U.S. Pat. No. 4,694,980; Rogers U.S. Pat. No. 4,925,075; Rogers and Clifton U.S. Pat. No. 5,018,654, the latter having a restraint device affixed to the inside of the holster, the device having a spring biased catch for engaging the trigger guard of the holstered handgun. The present invention is an improvement over these prior art holsters.

It is an object of the present invention to provide an improved handgun holster. It is another object of this invention to provide an improved holster having a novel means for restraining the handgun from being withdrawn from the holster until the wearer intends to do so. Still other objects will become apparent from the more detailed description which follows.

BRIEF SUMMARY OF THIS INVENTION

This invention relates to a handgun holster having a quick release withdrawal restraint, the holster having inner and outer sidewalls joined together along the back and the lower front portions to define an inner cavity having an open top and shaped to fit the handgun holstered therein, the holster having a restraining strap bridging the sidewalls across the open top and being pivotally attached at the ends of the strap to each of the sidewalls respectively, at least one pivotal attachment including a detent which prevents pivotal movement of the restraining strap until the strap is moved in a predetermined direction at the at least one pivotal attachment.

In specific and preferred embodiments of this invention the restraining strap is a semirigid material functioning as a spring bias to maintain a pawl in a notch in at least one pivotal attachment, and adapted to be pressed downwardly with preferably a thumb to release the pawl and to pivot the strap away from the handgun.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 3A:
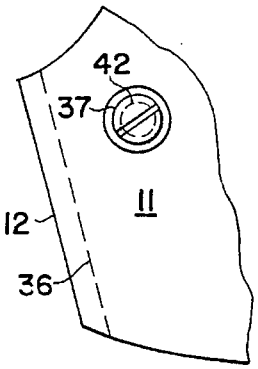
FIG. 3A is a partial right side elevational view showing a roller for use in positioning the handgun in the holster.

This invention is best understood by the following description with reference to the accompanying drawings.

FIGS. 1–5 show the handgun holster of this invention from five different views. The handgun holster is a holster preferably molded and shaped to receive and hold any chosen handgun, whether it be a revolver or a pistol, although this particular style is adapted best to holster a semi-automatic pistol. The holster is made by known techniques which involve molding the holster to fit the particular contours of the chosen pistol. The resulting holster is semirigid and may be ornamented on the outside with whatever surface decoration is desired. The inside surface of the holster has a felted texture to provide a smooth nonfrictional movement when inserting or withdrawing the handgun. The holster has an inside (next to the wearer) sidewall 10 and an outside sidewall 11 joined together at a front portion 13 and at lower a back portion 12 to form an interior cavity 14 with an open top 15 and an open bottom 16. It is optional whether the bottom 16 is open or closed, but preferably it is open to provide easy cleaning, absence of a vacuum buildup during withdrawal of the handgun, etc. The holster sidewalls 10 and 11 may be two separate pieces of material joined at the back 12 and the front 13 by stitching, riveting, screws and nuts, or the like. In the instance shown here sidewalls 10 and 11 are portions of one continuous piece of material which is folded along front portion 13 and sewed together along back portion 12 as at 36.

The principal improvement of this invention lies in the structure and operability of bridging strap 17 which swans the open top 15 of the holster and is pivotally attached to the top portions of the sidewalls 10 and 11, respectively. The pivotal attachments of bridging strap 17 to sidewalls 10 and 11, respectively, is by means of bolts or screws 21. Bridging strap 17 is adapted to pivot forwardly or upwardly about screws 21. On one of these attachments (shown here to be the attachment between strap 17 and inside sidewall 10) is a detent mechanism designed to maintain strap 17 in its upright position shown in the drawings until unlocked by thumb pressure and pivoted forward to the broken line position 39 to free the handgun from any restraint against withdrawal.

Figure 1:
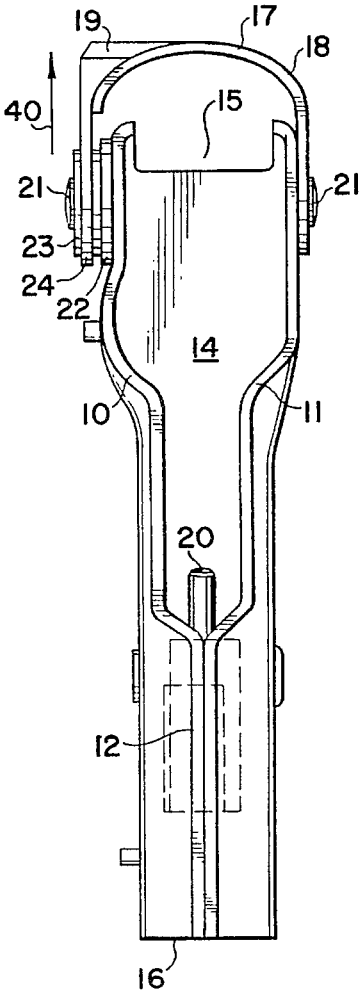
FIG. 1 is a rear elevational view of the handgun holster of this invention.
Figure 5:
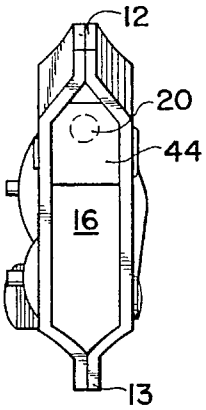
FIG. 5 is a bottom plan view of the handgun holster of this invention.
Figure 3:
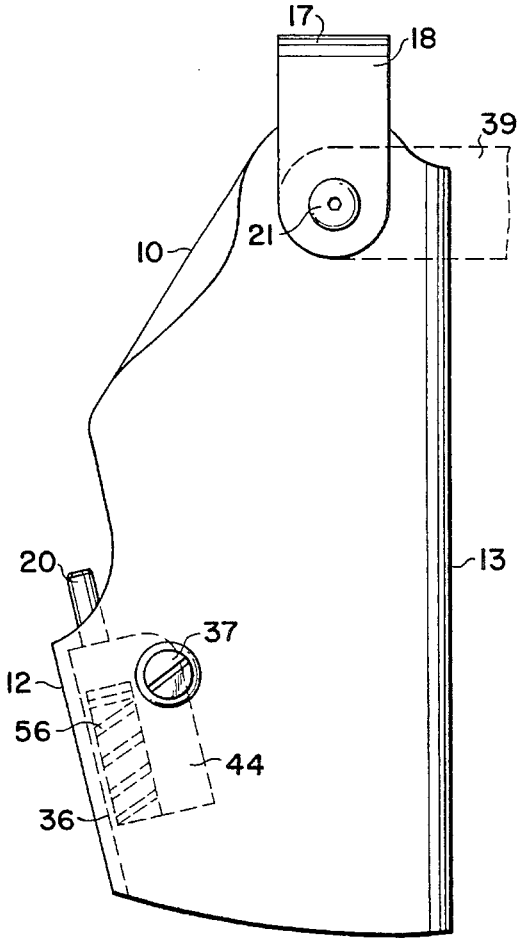
FIG. 3 is a right side (outside) elevational view showing a spring biased plunger used to position the handgun in the holster of this invention.

Bridging strap 17 has a spring portion 18 made of a semirigid material which is bent as shown in FIG. 1 and thereby is biased to straighten its bent portion 18 which translates into a force upward in the direction of arrow 40 for the holster shown herein.

Figure 6:
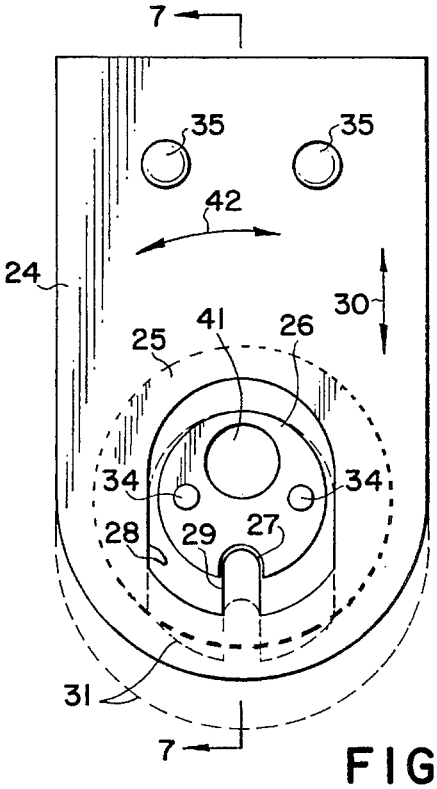
FIG. 6 is an enlarged side elevational view of one embodiment of the pivotal attachment between the holster and the restraining strap of this invention with the outside wall of the spool removed so as to view the interior mechanism.
Figure 7:
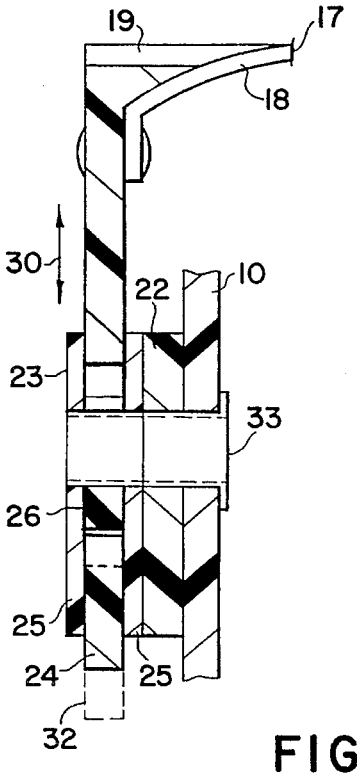
FIG. 7 is a cross-sectional view taken at 7—7 of FIG. 6, but with the outside wall replaced.

The attachment of strap 17 to screw 21 at the top portion of sidewall 10 is shown in enlarged views of FIGS. 6–9. Bridging strap 17, particularly springy section 18, is attached to vertical leg 24, preferably made of an appropriate plastic or other low friction material. In the embodiment of FIGS. 6–7 leg 24 has an enlarged cutout portion 28 which encircles central body 26 of spool 23. Spool 23 is a thin member, somewhat like the bobbin of a sewing machine, consisting of a central cylindrical body 26 separating two closely spaced end walls 25. These three components, body 26 and end walls 25 are rigidly joined together, in this instance by pins or rivets 34, although other joining methods such as cementing, welding, bolting, etc., may be used. Central body 26 contains a notch 27, and a through bore 41 through which the shaft of screw 21 passes to form the pivot means for bridging strap 17. Cutout opening 28 in leg 24 is fashioned with a pawl or tongue 29 which is sized to slide into and out of notch 27. Notch 27 and pawl 29 are oriented to be on the bottom side of screw 21, that is, on the opposite side of through bore 41 from the juncture of leg 24 and bridging strap 17, 18. The upper end of leg 24 is fastened to bridging strap 17, 18 by rivets 35 and is shaped to form a thumb ledge 19. Cutout opening 28 is larger than central body 26 of spool 23 permitting leg 24 to pivot around central body 26 except when pawl 29 is engaged with notch 27. The spring action of semi-rigid portion 18 of bridging strap 17 acts to maintain leg 24 in its most upward position where pawl 29 is engaged in notch 27. When the wearer's thumb is pressed, in a predetermined direction, herein shown as generally downwardly, on ledge 19, pawl 29 clears notch 27 and frees leg 24 to be rotated from its upright solid line position, shown in FIGS. 2–4, to its unrestraining broken line position 39, shown in FIGS. 2–4. It may be seen that leg 24 is sandwiched between end walls 25 of spool 23, and that spool 23 is positioned against washer 22 fitting around nut 33 that engages screw 21, permitting screw 21 to be tightened without affecting the mobility of leg 24, which is movable up and down in the direction of double arrow 30 and is pivotable in the direction of double arrow 42' when pawl 29 is free of notch 27 spool 23 may be made of plastic or metal.

Figure 8:
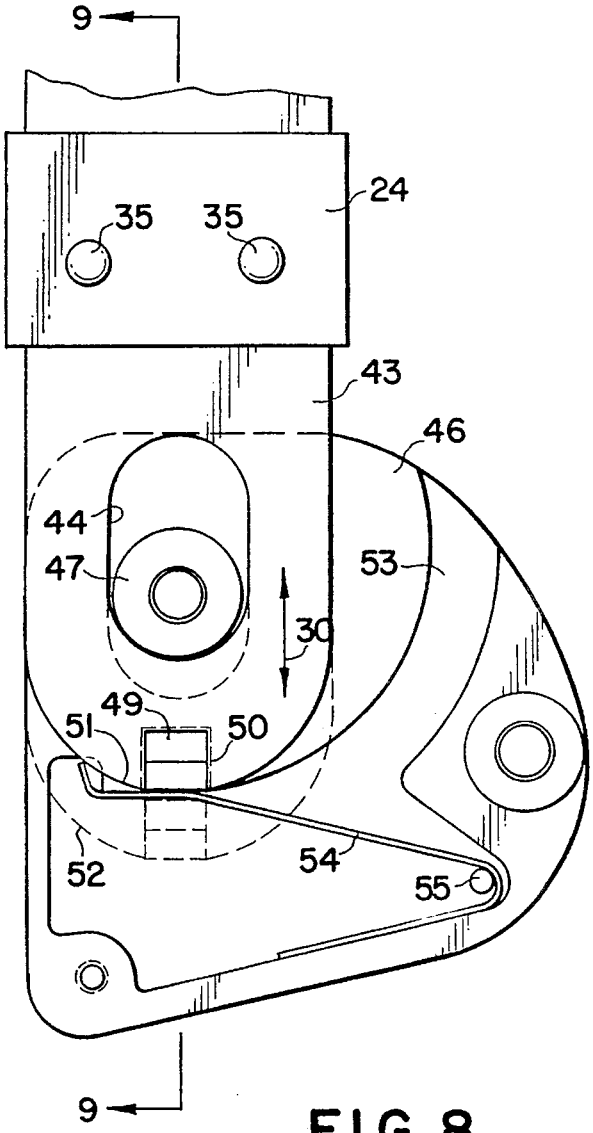
FIG. 8 is an enlarged side elevational view of a second embodiment of the pivotal attachment between the holster and the restraining strap of this invention with the outside cover of the detent means removed so as to view the interior mechanism.
Figure 9:
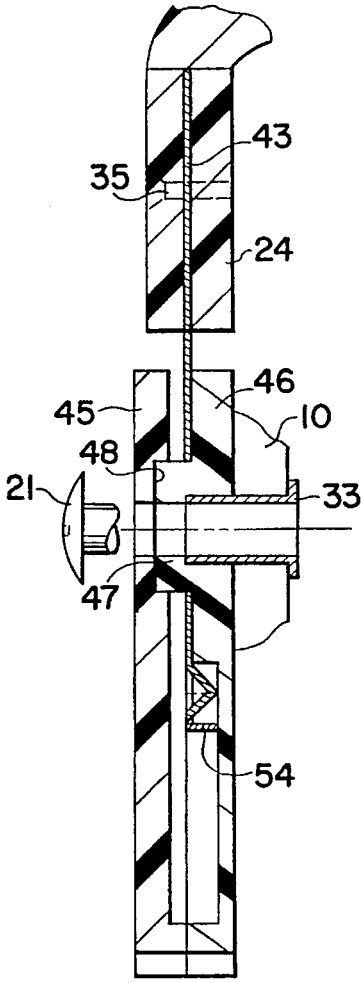
FIG. 9 is a cross-sectional view taken at 9—9 of FIG. 8.

In the embodiment of FIGS. 8–9 the same general operational features are employed in a different mechanism. A thin metal extension leg 43 depends downwardly from inside leg 24 and is sandwiched between inside cover 45 and outside cover 46. Inside cover 45 is removed in FIG. 8 for illustrative purposes. Leg 43 has a centrally located slot 44 having a vertical lengthwise axis. Slot 44 encircles circular boss 47 projecting inwardly from outside cover 46 and fits into a counterbore 48 in inside cover 45. An aligned bore through boss 47 and counterbore 48 provides a seat for nut 33 which engages screw 21. At the vertically lower portion of leg 43 is a crimped tongue 49, functioning as a pawl, which can slide vertically in the direction of arrow 30 to be engaged in notch 50 in the solid line up position or disengaged from notch 50 in the broken line down position 52. When tongue 49 is disengaged from notch 50 leg 43 can be rotated about boss 47 with tongue 49 sliding in cam groove 53 as restraining strap 17 is moved to forward position 39 (FIG. 2) to release the handgun for withdrawal. The embodiment of FIGS. 8–9 employs a leaf spring 54 around post 55 to maintain an upward force on tongue 49 to assist in keeping it in notch 50 until the wearer releases it by generally downward pressure on inside leg 24 and forward rotation of strap 17. Spring means other than leaf spring 54 can be employed for this purpose.

Figure 4:
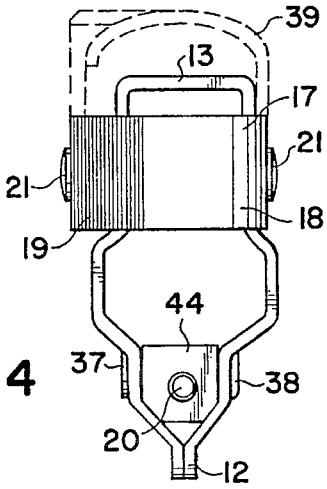
FIG. 4 is a top plan view of the holster of this invention showing the plunger of FIG. 3.
Figure 4A:
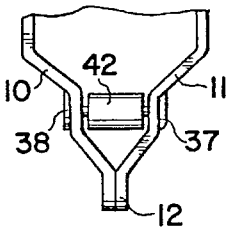
FIG. 4A is a partial top plan view showing the roller of FIG. 3A.
Figure 2:
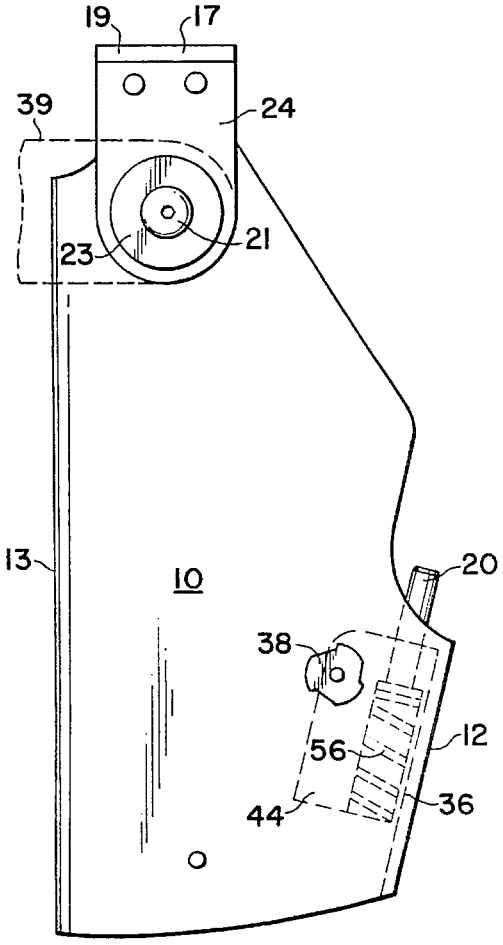
FIG. 2 is a left side (inside) elevational view of the handgun holster of this invention.

In order to provide good restraint by strap 17 in preventing unintentional withdrawal of the handgun, it is important to position the handgun so there is no looseness to strap 17 in its contact with the handgun. Two alternate devices are provided for this purpose. In FIGS. 1–5 there is shown a preferred device involving a plunger 20 pushed upwardly by spring 56, contained in a small housing 44 that is fastened in the holster by any convenient means, e.g., by means of screw 37 and nut 38. Plunger 20 presses upwardly against some available surface of the handgun, e.g., the trigger guard. An alternate device is shown in FIGS. 3A and 4A where a horizontal roller 42 is fastened in the interior cavity, e.g., at the location of screw 37 and nut 38. Roller 42 bears against any convenient surface, e.g., the trigger guard. In both instances the purpose of the device is to position the handgun so that restraining strap 17 fits snugly around the rear of the slide or the hammer of the handgun.

It may be seen that the wearer of this holster has the security of the handgun being kept within the holster cavity 14 until the wearer is ready to withdraw the handgun. A single quick movement of part of the hand, preferably the thumb, releases the restraint and permits a rapid draw of the handgun.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A handgun holster comprising a quick release withdrawal restraint, an inner and outer sidewall joined together along lower front and back portions to define an inner cavity having an open top shaped to fit a handgun holstered therein, an elongated restraining strap having opposite ends and a medial portion bridging said sidewalls across said open top, means for pivotal attachment of said opposite ends of said strap to respective said sidewalls to permit movement of said strap from a position across said open top to restrict handgun withdrawal to a position generally forwardly of said holster to permit handgun withdrawal, said means for pivotal attachment including a detent means releasably engaged with said means for pivotal attachment for preventing forward pivotal movement of said restraining strap until said strap is moved at said means for pivotal attachment in a predetermined direction.

2. The holster of claim 1 wherein said restraining strap is semirigid, said strap being spring biased to maintain said detent means in position to prevent pivotal movement of said strap.

3. The holster of claim 1 wherein said detent means includes a fixed notch and a movable pawl adapted to engage said notch and to be disengaged from said notch when said strap is moved in said predetermined direction.

4. The holster of claim 3 which additionally includes a horizontal roller in said interior cavity joining said sidewalls along said back portion and adapted to rest against a holstered handgun and to push it upwardly against said restraining strap.

5. The holster of claim 1 wherein said detent means includes a thin spool having two closely spaced end walls joined by a cylindrical body therebetween with a smaller diameter than that of said end walls, and having a radial notch, an annular member adapted to be rotatable around said cylindrical body between said end walls, said annular member having an inwardly directed radial tongue adapted to fit into said notch when aligned therewith, said spool being fixed with respect to said holster and said annular member being rotatable about said spool body and being radially movable into and out of said notch.

6. The holster of claim 1 which additionally includes a horizontal roller adapted to bear against a handgun and maintain its downward predetermined position in the holster and cause the restraining strap to snugly engage a handgun holsterable in said holster.

7. The holster of claim 1 which additionally includes a spring biased vertical plunger adapted to bear against a handgun to push it upwards against said restraining strap to secure a handgun against unintentional withdrawal from said holster.

8. The holster of claim 1 wherein said detent means includes two opposed interlocking thin covers, one said cover having a fixed notch to engage a pawl attached to a downwardly depending leg of said restraining strap, a circular cam surface to guide said pawl when said restraining strap is pivoted, and a spring means to bias said pawl into said notch.

9. A holster for a handgun comprising a pair of spaced sidewalls joined together at the front portions and at the lower back portions to define an interior cavity with an open top and having a restraining strap bridging over said open top, means for pivoting said strap to each of said pair of sidewalls, said bridging strap being located to prevent withdrawal of a handgun from said holster until said bridging strap is pivoted forward to release a handgun, a manually releasable means for attaching said strap to said sidewalls, said manually releasable means including a pivotable detent means connecting said strap to one said sidewall, said detent means including a spring biased pawl releasably locked into a notch for selectively preventing pivoting of said strap until said strap is moved toward said detent means to release said pawl from said notch.

10. The holster of claim 9 wherein said strap is bent and is sufficiently stiff to provide a spring biased force on said pawl.

11. The holster of claim 9 wherein said notch is located in the cylindrical body of a thin spool having two spaced end walls of larger diameter than that of said body therebetween; and said pawl is located on an annular member rotatable about said spool body between said end walls.

12. The holster of claim 9 wherein said strap includes a ledge adapted to be contacted by a portion of a hand of a user which withdraws a handgun from the holster, said ledge being pressable in a predetermined direction to release said pawl and pivot said strap forwardly.

13. The holster of claim 9 which additionally includes a spring-biased vertically movable plunger affixed to said holster and adapted to contact a handgun when holstered and to apply an upwardly directed force to a handgun to push it against said restraining strap.

14. The holster of claim 9 wherein said detent means includes two opposed interlocking thin covers, one said cover having a fixed notch to engage a pawl attached to a downwardly depending leg of said restraining strap, a circular cam surface to guide said pawl when said restraining strap is pivoted, and a spring means to bias said pawl into said notch.

15. The holster of claim 9 which additionally includes a horizontal roller in said interior cavity connecting said two sidewalls and adapted to maintain a handgun pressed upwardly against said strap.

16. A handgun holster comprising a main body having inner and outer sidewalls joined together along a lower front portion and a back portion to define an inner cavity having an open top and shaped to fit a handgun holstered therein, said holster having an elongated restraining strap having opposite ends and bridging said sidewalls across said open top, said strap being stiff and formed into a substantially inverted U-shaped; a pair of spaced pivot means for attaching said ends of said strap to said body, said pair of spaced pivot means being in substantial alignment to enable pivoting of said strap, at least one said pivot means including a detent means releasably engaged with said one pivot means for restricting forward pivotal movement of said restraining strap until said strap is moved at said one pivot means in a predetermined direction; and a spring biased movable plunger adapted to push a holstered handgun generally upwardly against said restraining strap.

17. The holster of claim 16 wherein said restraining strap is semi-rigid and springy for biasing said detent to its position to restrict pivotal movement of said strap.

18. The holster of claim 17 wherein said detent means is located on said main body adjacent a wearer.

19. The holster of claim 16 wherein said detent means includes a fixed notch and a movable pawl adapted to engage said notch and to be disengaged from said notch when said strap is pressed downwardly at said pivot means.

20. The holster of claim 16 wherein said detent means includes a thin spool having a pair of closely spaced end walls and a cylindrical body therebetween, said and walls having a predetermined diameter, said cylindrical body having a smaller diameter than said predetermined diameter, and having a radial notch, an annular member attached to said strap and adapted to be rotatable around said cylindrical body between said end walls, said annular member having an inwardly directed radial tongue for selective engagement into said notch when aligned therewith, said spool being fixed with respect to said main body and said annular member being rotatable about said cylindrical body and being radially movable to dispose its said tongue into and out of said notch.

21. The holster of claim 16 wherein said detent means includes two opposed interlocking thin covers, one said cover having a fixed notch to engage a pawl attached to a downwardly depending leg of said restraining strap, a circular cam surface to guide said pawl when said restraining strap is pivoted, and a spring means to bias said pawl into said notch.

* * * * *